United States Patent [19]

Ozu et al.

[11] Patent Number: 4,743,177

[45] Date of Patent: May 10, 1988

[54] ENCLOSED TYPE COMPRESSOR AND METHOD FOR ASSEMBLING THE SAME

[75] Inventors: Masao Ozu, Fuji; Tsuneo Monden, Tokyo, both of Japan

[73] Assignee: Kabushiki Kaisha Toshiba, Kawasaki, Japan

[21] Appl. No.: 40,714

[22] Filed: Apr. 21, 1987

Related U.S. Application Data

[60] Continuation of Ser. No. 829,120, Feb. 14, 1986, abandoned, which is a division of Ser. No. 706,624, Feb. 28, 1985, Pat. No. 4,584,750.

[30] Foreign Application Priority Data

Feb. 28, 1984 [JP] Japan ..... 59-36482

[51] Int. Cl.[4] ..... I04B 39/12

[52] U.S. Cl. ..... 417/360; 417/902

[58] Field of Search ..... 417/360, 902; 29/156.4 R

[56] References Cited

U.S. PATENT DOCUMENTS

| | | | |
|---|---|---|---|
| 2,043,215 | 6/1936 | Smith et al. | 417/902 X |
| 2,294,037 | 8/1942 | Kuches | 29/156.4 R |
| 2,395,065 | 2/1946 | Rataiczak | 29/156.4 R |
| 2,629,542 | 2/1953 | Dietles | 417/360 X |
| 3,526,942 | 9/1970 | Monden et al. | 29/156.4 R |
| 3,872,562 | 3/1975 | Pestel | 29/156.4 R |
| 4,584,750 | 4/1986 | Ozu et al. | 29/156.4 R |

*Primary Examiner*—Carlton R. Croyle
*Assistant Examiner*—T. Olds
*Attorney, Agent, or Firm*—Foley & Lardner, Schwartz, Jeffery, Schwaab, Mack, Blumenthal & Evans

[57] ABSTRACT

An enclosed type compressor comprises an electric motor and a compressor pump directly coupled with the electric motor, both enclosed in a casing. A centeradjusting plate having a through hole at the center is provided between the electric motor and the compressor pump. The center-adjusting plate is disposed perpendicular to the central axis of the internal surface of the stator of the electric motor. The rotor of the electric motor is coupled with the compressor pump and the combination thus obtained is secured to the center-adjusting plate in a manner such that the central axes of the rotor and the internal surface of the stator are aligned with each other. A method for assembling the enclosed type compressor is also disclosed.

12 Claims, 3 Drawing Sheets

ENCLOSED TYPE COMPRESSOR AND METHOD FOR ASSEMBLING THE SAME

This application is a continuation of application Ser. No. 829,120, filed Feb. 14, 1986, now abandoned, which is a division of application Ser. No. 706,624, filed Feb. 28, 1985, now U.S. Pat. No. 4,584,750.

BACKGROUND OF THE INVENTION

This invention relates to an enclosed type compressor to be used for a refrigerating system, for example, and a method for assembling the same.

An enclosed type compressor constructed such that an electric motor and a compressor pump assembly driven by the electric motor are enclosed in a sealed casing has been widely known. In such a compressor, the electric motor and the compressor pump assembly are ordinarily produced separately and then assembled together within the casing. In this case, the rotor of the electric motor is firstly connected with the driving shaft of the compressor pump assembly and then is inserted into the stator of the electric motor secured to the internal surface of the casing with a narrow air gap maintained between the outer surface of the rotor and the inner surface of the stator.

When the air gap is uneven, the rotor of the electric motor is urged toward a side having a narrower air gap, thus increasing the starting torque of the electric motor. Increased starting torque requires a starting apparatus of a large capacity, and in the worst case a larger size electric motor having an increased air gap, thus reducing the efficiency and power factor of the electric motor.

U.S. Pat. Nos. 3,850,551 and 3,872,562 disclose enclosed type compressors and methods for assembling the compressors wherein the stator of the electric motor is secured directly to the internal surface of a casing, while the compressor pump assembly is secured to a plate disposed perpendicular to the internal surface of the casing. During the assembling, the center-adjusting operation of the electric motor is carried out by use of a gap gauge, mandrel and the like. In this manner, although a plate is disposed perpendicular to the internal surface of the casing, the plate is not always perpendicular to the internal surface of the stator, and hence the central axis of the rotor tends to be inclined against the internal surface of the stator.

Although the internal surface of the casing is ordinarily machined cylindrically, the surface thereof tends to be deformed from a true cylindrical configuration because of irregularities in the material (particularly in the elongation property thereof) and as a result of welding or fitting of gas discharging and returning pipes, legs of a terminal block and the like to the casing, thus rendering the measurements of the internal surface of the casing to be inaccurate. Furthermore, the internal surface of the stator tends to be eccentric relative to the outer surface thereof due to the laminated construction of the stator, and for this and the above described reasons, the central axis of the internal surface of the stator tends to be misaligned with that of the casing. When the electric motor and the compressor pump assembly are assembled together with reference to the internal surface of the casing, the above described misalignment causes an air gap between the stator and the rotor to be uneven. Furthermore, the center adjusting operation utilizing the gap gauge or mandrel is difficult to be carried out automatically, thus requiring a long time and entailing drawbacks of accompanying large center adjusting errors. Since the above described center adjusting operation is advantageously carried out through an opening provided at an end of the casing remote from the compressor pump assembly, two openings are required to be provided through the casing at upper and lower ends thereof. The provision of two openings, however, requires further welding of cover plate to close the opening, and in consideration of the thermal effects, the spacing between the cover and various parts within the casing must be increased, thus increasing the size of the enclosed type compressor.

SUMMARY OF THE INVENTION

An object of the present invention is to provide an enclosed type compressor and a method for assembling the same for eliminating the problems and difficulties encountered with the prior art described hereinbefore.

Another object of the invention is to provide an enclosed type compressor and a method for assembling the same, wherein the center-adjusting operation between the rotor and the stator of the electric motor can be carried out at a high precision and the assembling operation of the compressor can be substantially simplified.

According to this invention, these and other objects of the present invention are achieved by providing an enclosed type compressor comprising a casing having an opening formed at at least one end thereof, an electric motor having a stator and a rotor, the stator being secured to an internal surface of the casing, a compressor pump assembly provided in the casing so as to be driven by the electric motor through a driving shaft, and a center-adjusting plate having a central portion formed with a through hole and an outer peripheral portion secured to the internal surface of the casing such that the center-adjusting plate is disposed perpendicularly to a central axis of the stator defined with reference to an internal surface of the stator, the center-adjusting plate fixedly mounting the compressor pump assembly at a position where an exact centering of the rotor coupled with the driving shaft is attained with reference to the internal surface of the stator.

According to the present invention, in another aspect, there is provided a method for assembling an enclosed type compressor comprising a casing having an opening formed at at least one end thereof, an electric motor having a stator and a rotor, the stator being secured to an internal surface of the casing, a compressor pump assembly provided in the casing and driven by the electric motor through a driving shaft, and a center-adjusting plate having an outer periphery secured to an internal surface of the casing and having a through hole at a central portion thereof, the method comprising the steps of inserting the stator of the electric motor into the casing through the opening and securing the stator to the internal surface of the casing, inserting afore-mentioned center-adjusting plate into the casing through the opening and securing an outer periphery thereof to the internal surface of the casing after the center-adjusting plate is disposed in perpendicular to the central axis of the internal surface of the stator, coupling the rotor of the electric motor to the driving shaft of the compressor pump assembly, and inserting the compressor pump assembly into the casing together with the rotor and securing the compressor pum assembly to the center-adjusting plate after the position of the compressor pump assembly is adjusted such that a central axis of the rotor aligns with a central axis of the internal surface of the stator.

The enclosed type compressor thus provided exhibits various advantageous features, such as precision centering of the rotor with reference to the internal surface of the stator, capability of assembling the enclosed type compressor through one opening provided at an end of the casing, reduction of the size of the casing and the electric motor, and improvement of the performance characteristics of the electric motor.

DESCRIPTION OF THE PREFERRED EMBODIMENTS

The preferred embodiments of this invention will now be described with reference to the accompanying drawings.

Figure 1:
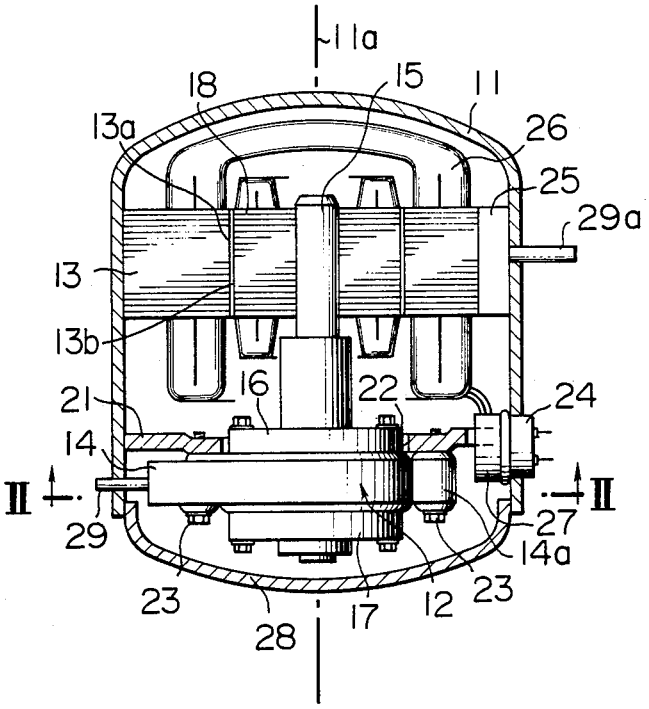
FIG. 1 is a longitudinal sectional view of an enclosed type compressor constituting a preferred embodiment of this invention.

Referring to FIG. 1, a preferred embodiment of the invention comprises a casing 11 having a longitudinal axis 11*a* which is initially provided with an opening at the bottom, and an electric motor (not numbered) and a compressor pump assembly 12 enclosed in the casing 11. A stator 13 of the electric motor is secured to the internal surface of the casing 11 for instance in a manner such that the outer diameter of the stator 13 is designed to be slightly larger than the inner diameter of the casing 11 and that the stator 13 is inserted into and secured to the casing 11 in a force-fit manner. The compressor pump assembly 12 comprises a cylinder 14 including a rolling piston, a vane, a vane spring and the like, all not shown, a driving shaft 15 for rotating the rolling piston, a main bearing (main end plate) 16 for rotatably supporting the shaft 15, and an auxiliary bearing (auxiliary end plate) 17. A rotor 18 of the electric motor is coupled to an end of the driving shaft 15 and is spaced from the internal surface 13*a* of the stator 13 by means of a gap 13*b* having a width which is substantially uniform.

Figure 2:
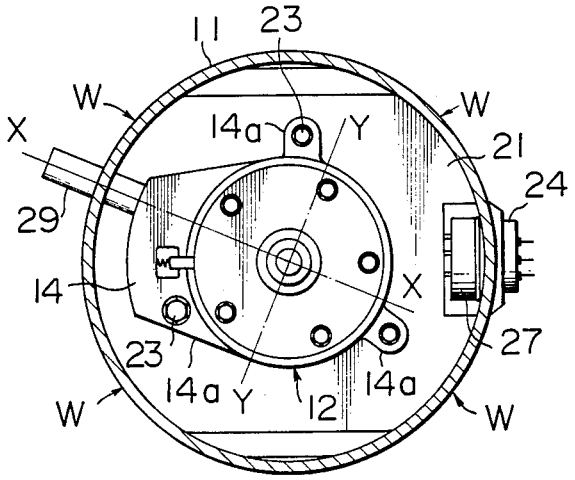
FIG. 2 is a sectional view of the compressor taken along the line II—II in FIG. 1.

The embodiment further comprises a center-adjusting plate 21 to which the compressor pump assembly 12 is secured. The center-adjusting plate 21 has, at a central portion thereof, a through hole having an outer diameter larger than that of the rotor 18. The peripheral portion of the center-adjusting plate 21 is secured to the internal surface of the casing 11 by, for instance, laser welding W as shown in FIG. 2. Furthermore, the center-adjusting plate 21 is secured to the casing in such a manner that it extends in a plane perpendicular to the central axis of the internal surface of the stato 13. The securing of the compressor pump assembly 12 to the center-adjusting plate 21 is performed by firstly inserting a portion including the main bearing 16 into the through hole 22 with a gap maintained therebetween and then securing three arms l4*a* of the cylinder 14 to the lower surface of the center-adjusting plate 21 by means of, for instance, bolts 23 as shown in FIG. 1.

Since a terminal block 24 is provided to be secured to the internal surface of the casing 11 by, for instance, welding at a position downward of the stator 13, a portion corresponding to the terminal block 24 of the stator 13 is partly cut away at 25 for preventing the interference with the inwardly projecting portion of the terminal block 24 during the insertion of the stator into the casing 11. The terminal block 24 is internally connected with lead wires of motor coils 26 in the stator 13 by means of connecting pieces 27. The opening of the casing 11 provided at the bottom thereof is thereafter closed by a cover 28 for providing a totally enclosed construction of the compressor apparatus. A coolant supplying pipe 29 and a coolant delivering tube 29*a* are provided to extend outwardly through the casing 11.

The method for assembling an enclosed type compressor of the above described construction will now be described.

Figure 3:
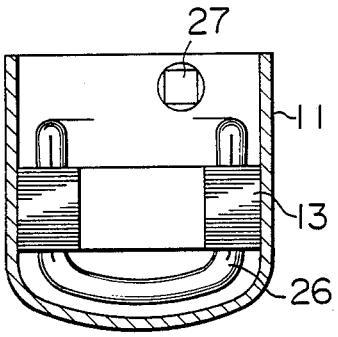
FIGS. 3, 4 and 5 are longitudinal sectional views, partially omitted, for explaining the assembling steps of the enclosed type compressor according to this invention.
Figure 4:
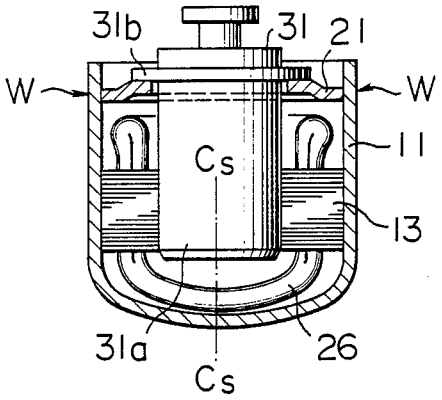
Figure 5:
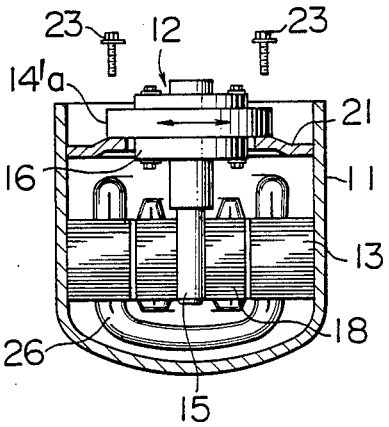

The stator 13 of the electric motor is inserted through the opening of the casing 11 into the same, and is secured to the internal surface of the casing 11 in a force fit, shrink fit and the like manner (see FIG. 3). Then, as shown in FIG. 4, the center-adjusting plate 21 is inserted into the casing 11 by use of a jig 31 such as an expansible mandrel so that the plate 21 is disposed perpendicular to the axis of the internal surface of the stator 13. The jig 31 includes a cylindrical portion 31*a* of a diameter initially smaller than the inner diameter of the stator 13 and expansible to the inner diameter hydraulically and a flange portion 31*b* extending perpendicularly to the cylindrical portion 31*a*. (When the jig 31 is so constructed that the diameter of the cylindrical portion 31*a* is substantially equal to the inner diameter of the stator 13, the expansion mechanism of the cylinder portion 31*a* is not required). The cylindrical portion 31*a* of the jig 31 is inserted through the hole 22 of the center-adjusting plate 21 until the flange portion 31*b* of the jig 31 abuts against the lower surface of the plate 21 to which the compressor pump assembly 12 is to be secured. In this state, the cylindrical portion 31*a* of the jig 31 is inserted into the stator 13 such that the axial distance between the center-adjusting plate 21 and the stator is set to a predetermined value. Then, the peripheral portion of the center-adjusting plate 21 is secured to the internal surface of the casing 11 by preferably applying laser light from outside of the casing 11. After the center-adjusting plate 21 has been secured, the jig 31 is pulled out of the casing 11.

By the above described procedure, the center-adjusting plate 21 is secured with reference to the internal surface of the stator 13 by use of the jig 31 so that the surface thereof for mounting the pump assembly 12 can be disposed accurately perpendicularly to the axis of the internal surface of the stator 13. Accordingly, even in a case where the axis of the internal surface is deviated from that of the internal surface of the casing 11, the surface of the center-adjusting plate 21 for mounting the pump assembly 12 is maintained at right angles to the axis of the internal surface of the stator 13 with high precision.

After the center-adjusting plate 21 is thus secured to the casing 11, the compressor pump assembly 12 coupled with the rotor 18 is inserted into the casing 11.

Since the hole 22 provided through the center-adjusting plate 21 has a diameter larger than that of the rotor 18, the rotor 18 thus coupled is inserted through the hole 22 into a required axial position in the stator 13, where the main bearing 16 of the pump assembly 12 is loosely inserted in the hole 22, while the arm portions 14*a* of the cylinder 14 are brought into abutment against the mounting surface of the center-adjusting plate 21.

The shaft 15 and the arm portions 14*a* of the cylinder are accurately machined so as to be disposed at right angles, while the rotor 18 is coupled with the shaft 5 in an exactly coaxial relation, so that an exact parallelism is maintained between the axis of the rotor 18 (with reference to the outer surface of the same) and the axis of the internal surface of the stator 13.

Then the center adjusting operation is carried out by slightly moving the compressor pump assembly 12 laterally while the assembly is kept in contact with the mounting surface of the center-adjusting plate 21. The center adjusting operation is carried out as follows by use of an automatic center-adjusting apparatus.

Figure 6:
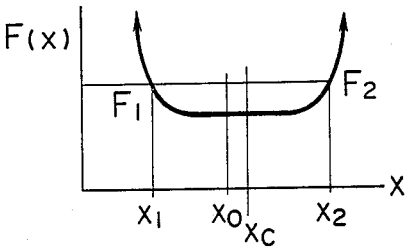
FIG. 6 is a graph for explaining the center-adjusting steps of the present invention.

When the compressor pump assembly 12 is moved in a sliding manner along the surface of the center-adjusting plate 21 in a direction of X axis as shown in FIG. 2, a force F(X) required for moving the assembly 12 increases abruptly when the outer surface of the rotor 18 abuts against the internal surface of the stator 13. The position $X_1$ where the force F(X) thus increases abruptly is detected electrically or mechanically, and is memorized in a memory device. Then the compressor pump assembly 12 is moved slidingly along the surface of the center-adjusting plate 21 in the opposite direction along the X axis, and a position $X_2$ where the outer surface of the rotor 18 contacts the opposite side of the internal surface of the stator 13 is read out and memorized in the memory device. The detecting procedure of the positions $X_1$ and $X_2$ will be described more in detail with reference to FIG. 6. When the compressor pump assembly 12 is moved along the X-axis, the force F(X) required for moving the pump assembly 12 horizontally is held at a constant value substantially equal to the frictional force between the mating surfaces of the center-adjusting plate 21 and the pump assembly 12 until the outer surface of the rotor 18 contacts the internal surface of the stator 13. When the outer surface of the rotor 18 starts contacting the internal surface of the stator 13, the force F(X) increases slightly during a time interval in which the pump assembly 12 moves along the surface of the center-adjusting plate 21 for a distance corresponding to a clearance or play (of ordinarily in a range of 0.01–0.03 mm) between the bearing 16 and the shaft 15. After reaching the extremities of the clearance or play, the shaft 15 starts to be bent, and the force F(X) required for the movement of the assembly 12 increases abruptly so as to follow a curve as shown in FIG. 6. The positions $X_1$ and $X_2$ are determined to be intersecting points $F_1$, $F_2$ between the curve and a straight line representing a predetermined level of the force F(X). The positions $X_1$ and $X_2$ thus determined are far more accurate than those detrmined by the conventional method utilizing a gap gauge or a mandrel.

Regardless of an initial position $X_o$ of the rotor 18, a position $X_c$ corresponding to the central axis of the internal surface of the stator 13 is calculated in the form of $X_c=(X_1+X_2)/2$. Likewise, a value $Y_c$ measured along Y axis perpendicular to the X axis, which corresponds to the central axis of the internal surface of the stator 13, can also be determined in a simple manner.

By use of the $X_c$ and $Y_c$, the position of the central axis $C_s$ of the internal surface of the stator 13 in the X-Y plane can be determined easily, and the central axis of the rotor 18 can be brought into alignment with the central axis $C_s$ of the internal surface of the stator 13.

After the centering operation aligning the central axis of the internal surface of the stator 13 with the central axis of the external surface of the rotor 18, the compressor pump assembly 12 thus held with respect to the center-adjusting plate 21 is clamped to be secured to the center-adjusting plate 21.

Various methods for securing the compressor pump assembly 12 to the above described position on the center-adjusting plate 21 may be considered. For instance, the assembly 12 may be beforehand loosely secured to the center-adjusting plate 21 by means of bolts 23, and after the assembly 12 has been positioned as described above, the assembly 12 may be secured tightly to the center-adjusting plate 21. Alternatively, the assembly 12 may be rotated, under the afore-mentioned condition held to the center-adjusting plate 21, to a position where the holes provided through the arms 14*a* of the cylinder 14 are brought into alignment with the threaded holes provided through the center-adjusting plate 21. Otherwise, after the centering operation, the suction port of the cylinder 14 is brought into alignment with a hole of the casing 11, through which the suction pipe 29 is to be extended, by use of, for instance, an optical noncontacting procedure, and then the arms 14*a* of the cylinder 14 are secured to the center-adjusting plate 21.

Figure 7:
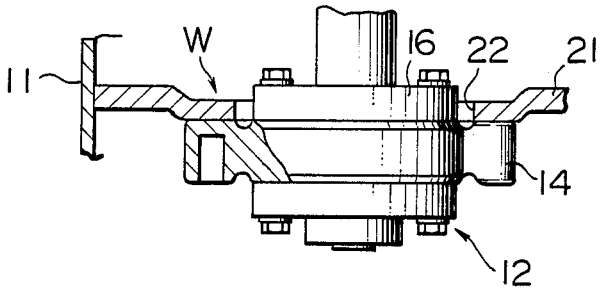
FIGS. 7 and 8 are diagrams, partly cut away, showing different embodiments wherein a compressor pump assembly is mounted on the lower side and the upper side of a center-adjusting plate, respectively.

It is preferable that the compressor pump assembly 12 is beforehand placed at a position where the suction port of the cylinder 14 is brought into alignment with the hole of the casing 11 passing the suction pipe, and the axis X is selected to be extending along the thus aligned direction. In this manner, the assembling work after the center adjusting operation can be substantially simplified. Beside of moving the compressor pump assembly 12 along the X and Y axes as described above, if the compressor pump assembly 12 is further moved in a direction inclined by 45° to the X and Y axes, the precision of the center-adjusting operation between the stator 13 and the rotor 18 will be improved. Instead of securing the pump assembly 12 to the center-adjusting plate 21 by means of bolts, it may be secured to the plate 21 by laser welding W as shown in FIG. 7. The application of the laser welding can prevent the related portions or members from being deformed as in the case of utilizing other welding procedure, eliminates the necessity of the bolt holes and tapped holes, and hence of the centering operation between these holes.

After the completion of the insertion of the compressor pump assembly 12 into the casing 11, a cover 28 is secured to close the opening of the casing 11 completely for providing an enclosed type compressor wherein the rotor of an electric motor is aligned with the stator of the same at a high precision.

According to this invention, since the compressor pump assembly is secured to the center-adjusting plate disposed perpendicular to the central axis of the internal surface of the stator and the center adjusting operation is carried out by contacting the rotor to the internal surface of the stator directly, a precision adjustment between the central axes of the rotor and stator can be realized regardless of the case where the central axis of the internal surface of the stator is oblique to the central axis of the internal surface of the casing.

Since there is no necessity of inserting a gap gauge between the internal surface of the stator and the external surface of the rotor and of the insertion of a mandrel between the driving shaft of the compressor pump assembly and the internal surface of the stator, the center adjusting operation is substantially simplified and an automatic assembling of the enclosed type compressor is thereby made possible. Furthermore, according to the invention the center-adjusting error can be substantially reduced in comparison with the conventional method utilizing the gap gauge and the mandrel.

Since the center adjusting operation of an extremely high precision is thus made possible, the efficiency of the electric motor can be substantially improved and an electric motor of a reduced size, improved starting characteristics and reduced noise can be realized.

The assembling or insertion of the electric motor and the compressor pump assembly can be effected through one end opening of the casing, thus reducing the production steps and eliminating the troublesome work for providing another end opening and closing the opening by welding a cover plate to the casing. Since the thermal effect caused by welding another cover plate is not taken into consideration, the spacing between the motor coil and the casing, and hence, the length of the casing can be reduced. Because no component member is inserted through the opposite end opening of the casing, the coil end of the electric motor may be formed into a closed construction (i.e. short path construction) as shown in FIG. 1, thus reducing the requirement of the coil conductor and improving the performance of the electric motor.

Although in the above described embodiment, the main bearing 16 provided on the pump assembly 12 has been inserted into the central hole 22 of the center-adjusting plate 21 loosely, the main bearing 16 may otherwise be inserted into the hole 22 with a gap between the main bearing 16 and the peripheral edge of the central hole 22 being far reduced than in the above described embodiment. In this case, the center adjusting operation is carried out without utilizing the automatic center-adjusting apparatus, and in an extreme case, by force-fitting the main bearing 16 in the hole 22. In this case, however, the precision of the center-adjusting operation is reduced in comparison with that utilizing the automatic center-adjusting appratus. Although a case where the compressor pump assembly 12 is moved in a sliding manner along the surface of the center-adjusting plate 21 has been described, it is apparent that the center adjusting operation may be carried out such that the compressor pump assembly 12 is held stationary while the stator 13 of the electric motor is held movable.

Figure 8:
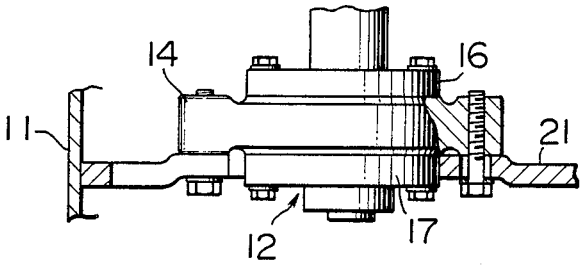

Although an example in which the compressor pump assembly 12 is mounted on the lower surface of the center-adjusting plate 21 has been described, it is apparent that the assembly 12 may otherwise be mounted on the upper side surface of the center-adjusting plate 21 in the case where the central hole 22 of the plate 21 is made sufficiently large so that the cylinder 14 of the assembly 12 can pass through the central hole 22 (see FIG. 8). In this case, the cylinder 14 is inserted through the central hole 22, turned around its axis such that the bolt holes of the arms 14*a* are aligned with the tapped holes of the center-adjusting plate 21, and then the pump assembly 12 is secured to the upper side surface of the center-adjusting plate 21 by driving the bolts in tight engagement. Furthermore, the casing 11 may be provided with two openings at both ends thereof, or otherwise a casing of a non-cylindrical configuration may be utilized in this invention. In this case, the central hole 22 of the center-adjusting plate 21 may be of a diameter smaller than that of the rotor 18.

Although this invention has been described with respect to embodiments wherein the compressor is of a rotary type, it is apparent that the invention is also applicable to a compressor of a reciprocating type or a scroll type.

Furthermore, whereas a construction having a stator directly secured to the internal surface of the casing has been disclosed, an inner casing (of a cylindrical construction) may be further provided in the casing, and the electric motor and the compressor pump assembly may be secured to the inner casing directly.

What is claimed is:

1. An enclosed type compressor comprising:

a casing having an integrally closed top and an opening formed at the bottom end thereof;

an electric motor having a stator and a rotor, said stator being secured to an internal surface of said casing adjacent to said closed top;

an air gap of substantially uniform width formed between said rotor and said stator;

a compressor pump assembly provided adjacent said bottom end of said casing so as to be driven by said electric motor through a driving shaft; and means for centering said rotor with reference to an internal surface of said stator irrespective of the orientation of said rotor with said casing, said centering means including a center-adjusting plate having a central portion formed with a through hole and an outer peripheral portion secured to the internal surface of said casing such that said center-adjusting plate is permanently fixed perpendicularly to a central axis of said stator defined with reference to said internal surface of said stator without reference to said internal surface of said casing or to the position of said rotor with respect to said stator, said center-adjusting plate fixedly mounting said compressor pump assembly at a position where an exact centering of said rotor coupled with said driving shaft is consistently and repeatedly attained with reference to said internal surface of said stator.

2. An enclosed type compressor according to claim 1 wherein said through hole formed at a central portion of said center-adjusting plate has a diameter larger than the outer diameter of said rotor.

3. An enclosed type compressor according to claim 1 wherein said compressor pump assembly is provided with a bearing portion which is inserted loosely in said central through hole of said center-adjusting plate.

4. An enclosed type compressor according to claim 1 wherein said center-adjusting plate has an outer peripheral portion secured to said internal surface of said casing by laser welding.

5. An enclosed type compressor according to claim 1, wherein said through hole of said center-adjusting plate is made sufficiently large such that said pump assembly is mounted on a side of said center adjusting plate away from said stator.

6. An enclosed type compressor according to claim 1, wherein said pump assembly is secured to said center-adjusting plate by bolt means.

7. An enclosed type compressor according to claim 1, wherein said pump assembly is secured to said center-adjusting plate by laser welding.

8. An enclosed type compressor according to claim 1, wherein said center adjusting plate is of unitary construction.

9. An enclosed type compressor according to claim 4, wherein said center-adjusting plate is of unitary construction.

10. An enclosed type compressor according to claim 1, wherein said casing has a longitudinal axis, and wherein said internal surface of said casing has a tolerance insufficient for providing said uniform gap when said rotor is aligned with said longitudinal axis.

11. An apparatus for centering a rotor within a stator of an electric motor contained in an enclosed type compressor having a casing, in order to maintain a predetermined distance between said rotor and stator, said stator being secured to an internal surface of said, casing said casing having an integrally closed top and said rotor being secured to a drive shaft extending from said motor and coupled to a compressor pump assembly, said apparatus comprising:

a. a center-adjusting plate having a central portion formed with a through hole and an outer peripheral portion secured to the internal surface of said casing for fixedly mounting said compressor pump assembly at a position where an exact centering of said rotor coupled with said driving shaft is attained with reference to said internal surface of said stator;

b. a jig for locating said center-adjusting plate perpendicularly to a central axis of said stator defined with reference to an internal surface of said stator without reference to said internal surface of said casing, said jig being cylindrical in shape and having a diameter approximately equal to an inner diameter of said stator and larger than the diameter of said rotor, wherein the difference between the diameter of said jig and the diameter of said rotor is approximately equal to said predetermined distance, said jig being inserted into said stator prior to the securing of said center-adjusting plate to the internal surface of the casing and removed before the insertion of said rotor into said stator.

12. An apparatus as claimed in claim 11, wherein said jig is expandable from an initial diameter to said diameter approximately equal to said inner diameter of said rotor.

* * * * *